US005531340A

United States Patent [19]

Dudzik

[11] Patent Number: 5,531,340

[45] Date of Patent: Jul. 2, 1996

[54] CLOSURE DEVICE WITH ROLLER-OPERATED TEAR TAB

[75] Inventor: Mark H. F. Dudzik, Forest Town, England

[73] Assignee: Galen (Chemicals) Limited, Foxrock, Ireland

[21] Appl. No.: 343,753

[22] Filed: Nov. 22, 1994

[30] Foreign Application Priority Data

Nov. 25, 1993 [IE] Ireland ..... S93/0903

[51] Int. Cl.[6] ..... B65D 39/00; B65D 47/36

[52] U.S. Cl. ..... 215/254; 220/254; 220/266; 220/270; 222/541.9

[58] Field of Search ..... 222/541.6, 541.9; 220/254, 260, 265, 266, 267, 268, 269, 270, 271, 272, 273, 274, 284; 215/254

[56] References Cited

U.S. PATENT DOCUMENTS 1,812,111 6/1931 Mock ..... 220/274

3,448,887 6/1969 Geiger .

3,687,328 8/1972 Spruyt et al. ..... 220/324

4,301,940 11/1981 Cvacho ..... 220/274 X

*Primary Examiner*—Allan N. Shoap

*Assistant Examiner*—Robin A. Hylton

*Attorney, Agent, or Firm*—William C. Geary, III; Lahive & Cockfield

[57] ABSTRACT

A tamper-evident closure device (11) for a container (10) has a tear tab (17) which can be at least partially detached by tearing to leave an opening through which the contents of the container (10) can be removed. A roller (18) integral with one edge (17*b*) of the tab (17) has an operating member (19) for manually rotating the roller (18) back across the tab (17) from the one edge (17*b*) such that during such rotation the tab (17) is progressively torn away starting at the one edge (17*b*).

10 Claims, 4 Drawing Sheets

CLOSURE DEVICE WITH ROLLER-OPERATED TEAR TAB

BACKGROUND OF THE INVENTION

1. Field of the Invention

This invention relates to a tamper-evident closure device for a container and is applicable, though not exclusively, to a bottle for sterile water or antiseptic liquid for use in hospitals.

2. Description of the Prior Art

Closure devices are known which comprise a tear tab which normally seals the container but which can be at least partially detached by tearing to leave an opening through which the contents of the container can be removed. One example of such a device is the so-called "ring pull" closure for canned drinks, wherein a ring is attached to a tear tab and by pulling back on the ring the tab can be removed. Similar closure devices have been used on containers for other consumables, such as milk cartons.

An advantage of such devices is that they are "tamper-evident", meaning that they cannot be re-sealed once opened so that any tampering can be detected. This is especially important when it is necessary to detect a possible contamination of the container contents. However, a disadvantage of such closure devices is that they require a relatively large force to start the tear. Further, once the initial tear is made the force required to continue the tear drops substantially so that the tab removal is uncontrolled and liquid spillage often results.

It is an object of the invention to provide an improved closure device which mitigates this problem.

SUMMARY OF THE INVENTION

Accordingly, the invention provides a tamper-evident closure device for a container, comprising a tear tab which can be at least partially detached by tearing to leave an opening through which the contents of the container can be removed, the device further comprising a roller attached to the tab adjacent one edge and an operating member attached to the roller for manually rotating the roller back across the tab from the one edge whereby during such rotation the tab is progressively torn away starting at the said one edge.

The closure device may be manufactured together with and as an integral part of a container or, alternatively, manufactured as a separate device for subsequent fitting to the neck of a container. Accordingly, the invention also provides a container having a closure device as described hereinabove.

The advantage of the invention, as compared to the known ring-pull devices, is that a more controllable opening requiring less initial force can be achieved.

Embodiments of the invention will now be described, by way of example, with reference to the accompanying drawings, in which:

DESCRIPTION OF THE PREFERRED EMBODIMENTS

Figure 1:
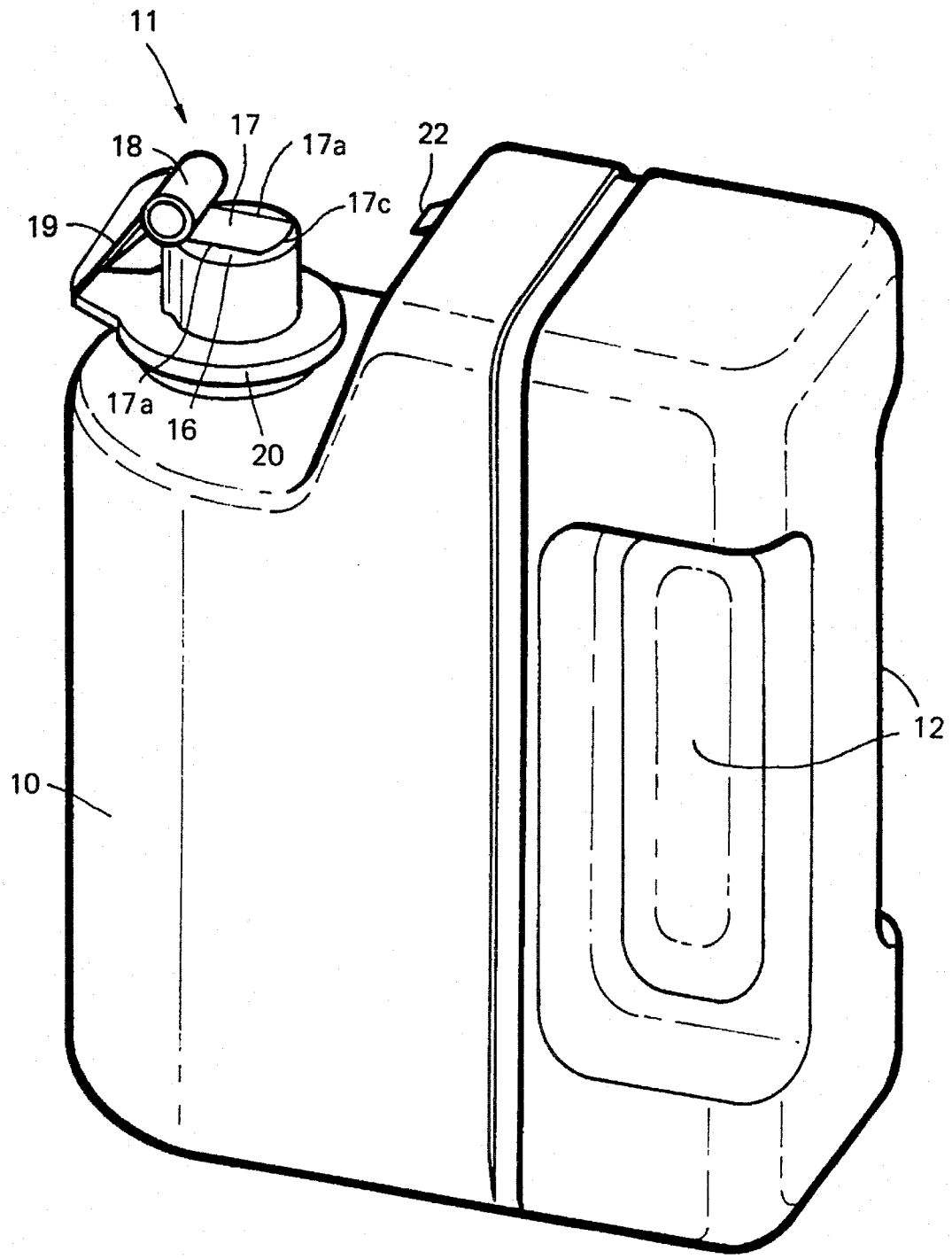
FIG. 1 is a perspective view of a bottle having a closure device according to a first embodiment of the invention with the bottle closed.

Referring now to FIGS. 1 to 4 of the accompanying drawings, a container or bottle 10 for sterile water or antiseptic liquid has a closure device 11 according to a first embodiment of the invention. The bottle 10 is blow moulded in conventional manner in polypropylene or other suitable plastics material, and has recesses 12 so shaped as to form a handle. The closure device 11 is manufactured separately from the bottle 10 as a one-piece injection moulding in conventional manner in polypropylene or other suitable plastics material. The closure device comprises a closure member having a cylindrical skirt 13 (see FIG. 2) which is a force-fit into a re-entrant cylindrical neck 14 of the bottle 10. A circumferential recess 15 on the neck 14 is provided, in which a weld seal (not shown) is located, to give an airtight seal. The weld seal may be actuated by ultrasonics or radio frequency (rf) or in any other conventional manner. Alternatively, one or more circumferential ribs (not shown) on the skirt 13 could seal against the interior surface of the neck 14 to give an airtight seal. As already mentioned, the closure device 11 may, alternatively, be manufactured with, and as an integral part of, the bottle 10.

A top surface 16 of the closure device 11 has a portion forming a tear tab 17, the tear tab 17 having parallel side edges **17*a* and an arcuate front edge 17*b*. The tear tab 17 is an integral part of the top surface 16, and is delimited therefrom by lines of weakness at its edges 17*a* which are of thinner material than the rest of the top surface 16 so that the tab 17 may be detached from the surrounding portion of the top surface 16 in a pre-determined manner by tearing along its edges 17*a*. Alternatively, the entire tab 17 may be of thinner material than the surrounding portion of the top surface 16, rather than just its edges 17*a*. While the accompanying drawings show the tab 17 having a rear edge 17*c*, this is not absolutely necessary as the tab 17 is never fully removed from the closure device 11**.

A cylindrical roller 18 is formed integrally with the tab 17 adjacent its front edge **17*b*. The axis of the roller 18 is perpendicular to the parallel side edges 17*a* of the tab 17. An operating member or lever 19 is formed integrally with and extends approximately tangentially away from the roller 18, downwardly and forwardly in front of the closure device 11. Below the top surface 16, the closure device 11 has a collar 20, and the free end 19*a* of the lever 19 is integrally attached to the collar 20**.

Figure 2:
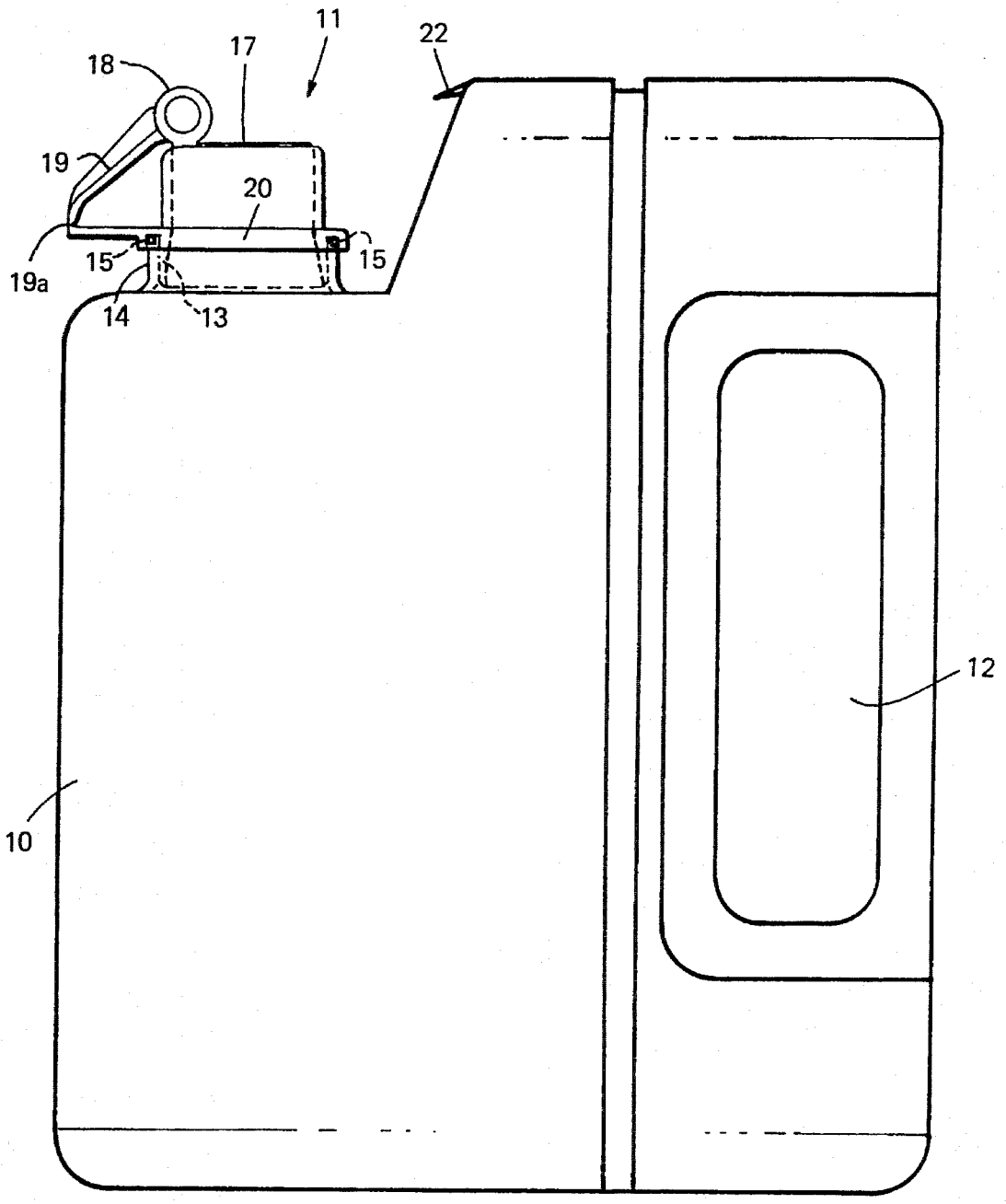
FIG. 2 is a side view of the bottle of FIG. 1 with the bottle closed.

Before the bottle 10 is opened, the bottle 10 and closure device 11 are as shown in FIGS. 1 and 2. Thus the tear tab 17 is in place sealing the interior of the bottle 10 and the free end **19*a* of the lever 19 is attached to the collar 20. To open the bottle 10, the connection between the free end 19*a* of the lever 19 and the collar 20 must first be broken. This prevents inadvertent opening of the closure device 11. Now the lever 19 is rotated manually upwardly and backwardly over the top surface 16 of the closure device 11 (clockwise as seen in FIG. 2) so as to rotate the roller 18 back across the tab 17 from the front edge 17*b* towards the rear edge 17*c*. During this rotation, the tab 17 is progressively torn away starting at the front edge 17***b* with the tab 17 being wrapped around the circumference of the roller 18 (see FIGS. 3 and 4).

Figure 3:
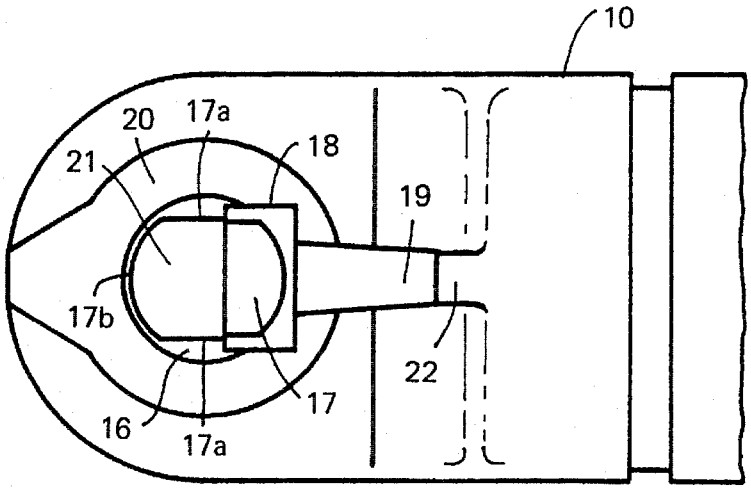
FIG. 3 is a plan view of the first embodiment of closure device on the bottle with the bottle open.
Figure 4:
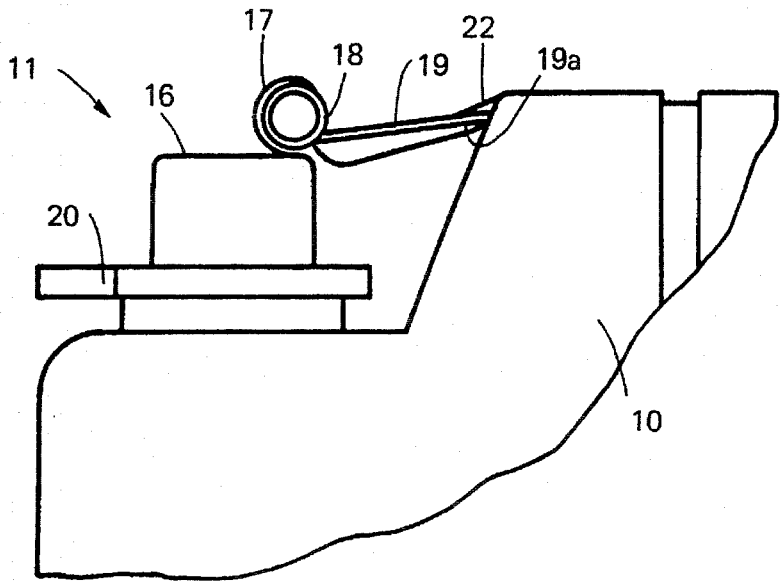
FIG. 4 is a side view of the first embodiment of closure device on the bottle with the bottle open.

The diameter of the roller 18 is such that, during the approximate 225 degree rotation of the roller 18 from the closed condition of the closure device 11 in FIGS. 1 and 2 to the open condition in FIGS. 3 and 4, substantially the entire length of the tab 17 is detached from the top surface 16. The axial length of the roller 18 is greater than the width of the tab 17, i.e. greater than the distance apart of the side edges 17*a*, so that the opposite ends of the roller 18 are supported by the opposite edges of the top surface 16 of the closure member 11 on either side of the tab 17 during rotation of the roller 18. This stabilizes the roller 18.

Removal of the tab 17 leaves an opening 21 through which the contents of the bottle 10 (in this case sterile water or antiseptic liquid) can be poured. The arcuate form of the front edge 17*b* facilitates pouring. The free end 19*a* of the lever 19 can be latched under a latch means or small projection 22 formed on the bottle 10, to prevent the inherent resilience of the material of the tab 17 causing the latter to partially unroll back across the opening 21.

Figure 5:
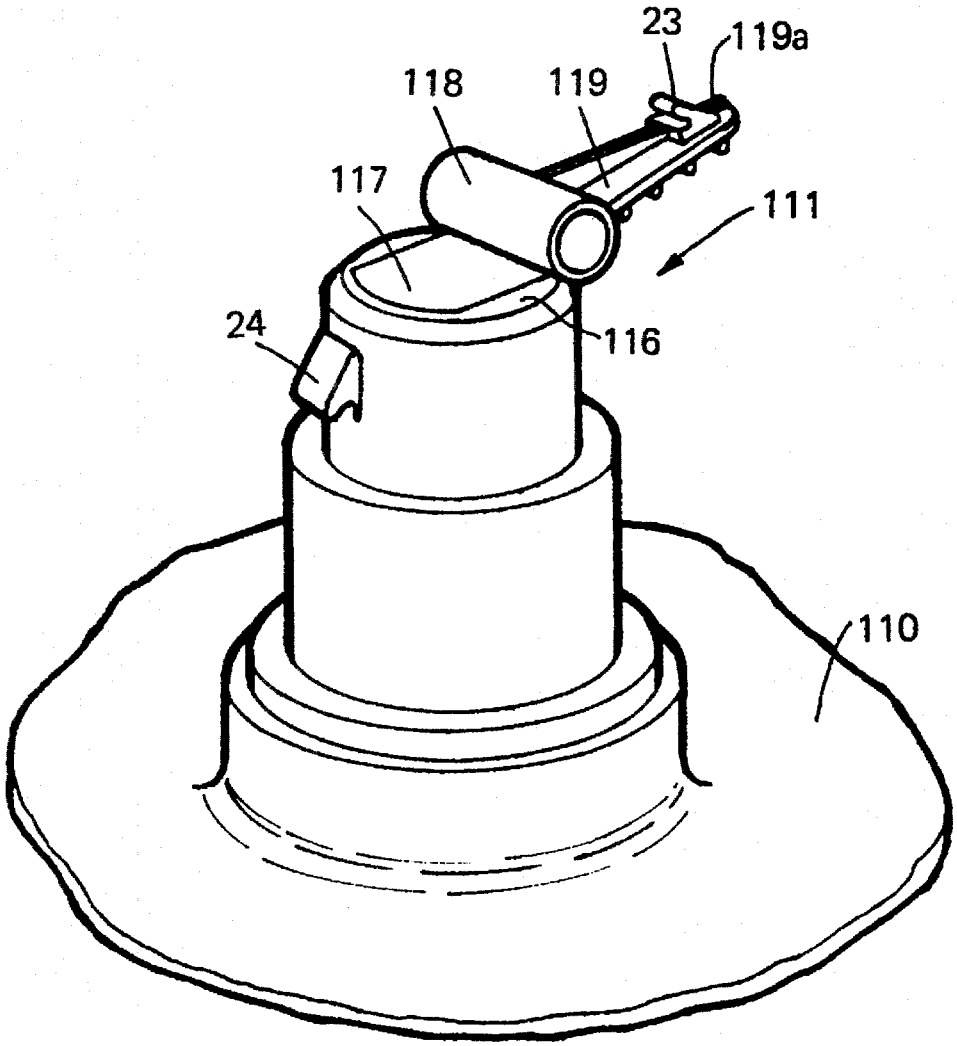
FIG. 5 is a perspective view of a second embodiment of closure device according to the invention.

A second embodiment of closure device 111 of the invention is shown in its closed condition in FIG. 5. The main difference from the first embodiment is that the free end 119*a* of the lever 119 is provided with a catch 23 which can latch with a further catch 24 on the side of the closure device 111 when the lever 119 is rotated back over the top surface 116 of the closure device 111 to detach the tab 117 and open the bottle 110. The catches 23 and 24 are required in this case because it is assumed that the bottle 110 is not so designed as to have a wall conveniently located alongside the closure device 111 upon which a catch such as the projection 22 can be located; thus the closure device 111 has to have its own self-contained latch means to prevent unrolling of the tab 117 after the bottle 110 has been opened.

The advantage of the arrangements described above is that the roller 18, 118 acts as a fulcrum which translates a large movement at the free end 19*a*, 119*a* of the lever 19, 119 to a small movement at the tab 17, 117 so that initial opening of the tab 17, 117 requires little effort and the subsequent detachment of the tab 17, 117 is controlled. Of course, since in the embodiments only just over half of the circumference of the roller 18, 118 is used (approximately 225 degrees), it is not strictly necessary for the entire circumference of the roller 18, 118 to be present. Further, the roller 18, 118 need not be of circular cross-section as shown. The cross-section can be varied to provide any desired opening characteristics, for example, a slow initial tear at and near the front edge 17*b*, 117*b* followed by progressively more rapid tearing along the side edges 17*a*, 117*a*.

What is claimed is:

1. A tamper-evident closure device for a container, the closure device comprising a closure member;

a tear tab formed integrally with the closure member and being at least partially detachable from the closure member by tearing to leave an opening in the closure member;

a roller attached to the tear tab adjacent one edge of the tear tab; and an operating member attached to the roller for manually rotating the roller back across the tear tab from said one edge whereby during such rotation the tab is progressively torn away starting at the said one edge, the diameter of the roller being such that substantially the entire length of the tear tab is detached from the closure member by rotation of the roller through an angle of less than 360 degrees.

2. A closure device as claimed in claim 1, wherein a portion of the operating member is attached to a portion of the closure device away from the roller so as to prevent rotation of the roller without breaking the attachment.

3. A closure device as claimed in claim 1, wherein the operating member is a lever.

4. A closure device as claimed in claim 2, wherein the operating member is a lever.

5. A closure device as claimed in claim 1, wherein the length of the roller is greater than the width of the tab so that the ends of the roller are supported by the closure member on either side of the tab during rotation of the roller.

6. A closure device as claimed in claim 2, wherein the length of the roller is greater than the width of the tab so that the ends of the roller are supported by the closure member on either side of the tab during rotation of the roller.

7. A closure device as claimed in claim 1, wherein said closure member comprises a skirt for force fitting into the neck of a container.

8. A closure device as claimed in claim 1, wherein the closure device is made as a one-piece moulding of plastics material.

9. A closure device as claimed in claim 2, wherein the closure device is made as a one-piece moulding of plastics material.

10. The closure device as claimed in claim 1 in combination with a container, the container including means for latching the operating member of the closure device in the open condition of the container.

* * * * *